US007217232B2

(12) United States Patent
Shoebridge et al.

(10) Patent No.: US 7,217,232 B2
(45) Date of Patent: May 15, 2007

(54) AUTOMATIC PAPER FOLDER

(75) Inventors: Donald Thomas Shoebridge, Huntington, IN (US); George Arthur Carver, Wabash, IN (US)

(73) Assignee: SOP Services, Inc., Las Vegas, NV (US)

( * ) Notice: Subject to any disclaimer, the term of this patent is extended or adjusted under 35 U.S.C. 154(b) by 109 days.

(21) Appl. No.: 10/973,839

(22) Filed: Oct. 26, 2004

(65) Prior Publication Data

US 2006/0089245 A1 Apr. 27, 2006

(51) Int. Cl.
*B31B 1/26* (2006.01)

(52) U.S. Cl. ..... 493/405; 493/403; 493/420; 493/424; 271/121; 271/124; 271/241

(58) Field of Classification Search ..... 493/403, 493/405, 420, 424; 271/121, 124, 241, 147, 271/160

See application file for complete search history.

(56) References Cited

U.S. PATENT DOCUMENTS

| | | | | |
|---|---|---|---|---|
| 4,573,672 | A * | 3/1986 | Lehmann et al. | 270/45 |
| 4,603,848 | A * | 8/1986 | Markgraf et al. | 271/125 |
| 4,842,574 | A * | 6/1989 | Noble et al. | 493/421 |
| 4,869,712 | A | 9/1989 | Ishino | |
| 6,224,530 | B1 * | 5/2001 | Okelmann et al. | 493/420 |
| 6,554,271 | B1 * | 4/2003 | Lindsay et al. | 271/121 |
| 6,644,646 | B1 * | 11/2003 | Lindsay et al. | 271/4.08 |
| 6,783,488 | B1 * | 8/2004 | Shoebridge et al. | 493/420 |

* cited by examiner

*Primary Examiner*—Hemant M. Desai

(57) ABSTRACT

This invention provides an automatic paper folder with the adjustable distance between a retarder and a feeding wheel assuring the consistency of the automatic feed for most types of paper. The automatic paper folder includes a paper feed assembly that combines the functions of a retractable retarder and a retractable tension block, assuring the automatic feed of a stack of paper, and a bypass for the manual feed of the stapled sets.

3 Claims, 4 Drawing Sheets

AUTOMATIC PAPER FOLDER

TECHNICAL FIELD

The technical field of this disclosure is the paper folders, particularly, the automatic paper folders having means for the automatic and manual paper feed.

BACKGROUND OF THE INVENTION

Paper folders are used to fold a sheet of paper into sections in order to fit this sheet into an envelope. Typically, the paper folders use a series of rollers to grab and move the sheet of paper being folded through the folding process, and crease the material as it passes between sets of contacting rollers.

Contemporary paper folders could fold the sheet of paper into two sections in one fold, or into three or four sections in two folds. The four section fold is usually limited to the double parallel fold. The most common folds are: half-fold, letter fold, z-fold, double parallel fold, and brochure fold.

The variety of paper available on the market today causes difficulty with the automatic feed. Some paper is thin, other is thick. The automatic paper folder must be adaptable to virtually any paper available on the market.

Another important requirement for today's paper folder is the choice of automatic or manual feed. The user can feed the paper either sequentially sheet-by-sheet, or automatically by placing a stack of paper into a paper feed assembly.

Depositing the stack of paper permits a high-speed operation, while feeding the sheets sequentially is time-consuming. However, the automatic feeding of the stapled sets is not possible.

The U.S. Pat. No. 4,869,712 Masahiro Ishino discloses a paper folding apparatus having two inlets, one adapted for the automatic feeding, and another—for manual feeding. Having two inlets also requires in two paper paths with all the extra parts and increased size.

In a portable and inexpensive folder, it would be desirable to have a single inlet. A bypass is required in order to feed the stapled sets sequentially through the automatic paper feed inlet.

SUMMARY OF THE INVENTION

One object of this invention is an automatic folder with the consistent automatic feed. This invention provides the paper folder with the adjustable distance between a retarder and a feeding wheel assuring the consistency of the automatic feed for most types of paper.

Another object of this invention is a paper folder providing the user with the on-demand automatic or manual feed. The automatic folder of this invention provides a paper feed assembly that combines the functions of a retractable retarder and a retractable tension block, assuring the automatic feed of a stack of paper and a bypass for the manual feed of the stapled sets.

The foregoing and other features and advantages of the invention will become further apparent from the following detailed description of the presently preferred embodiments, read in conjunction with the accompanying drawings.

The detailed description and drawings are merely illustrative of the invention, rather than limiting the scope of the invention being defined by the appended claims and equivalents thereof.

DESCRIPTION OF THE PRESENTLY PREFERRED EMBODIMENT

Figure 1:
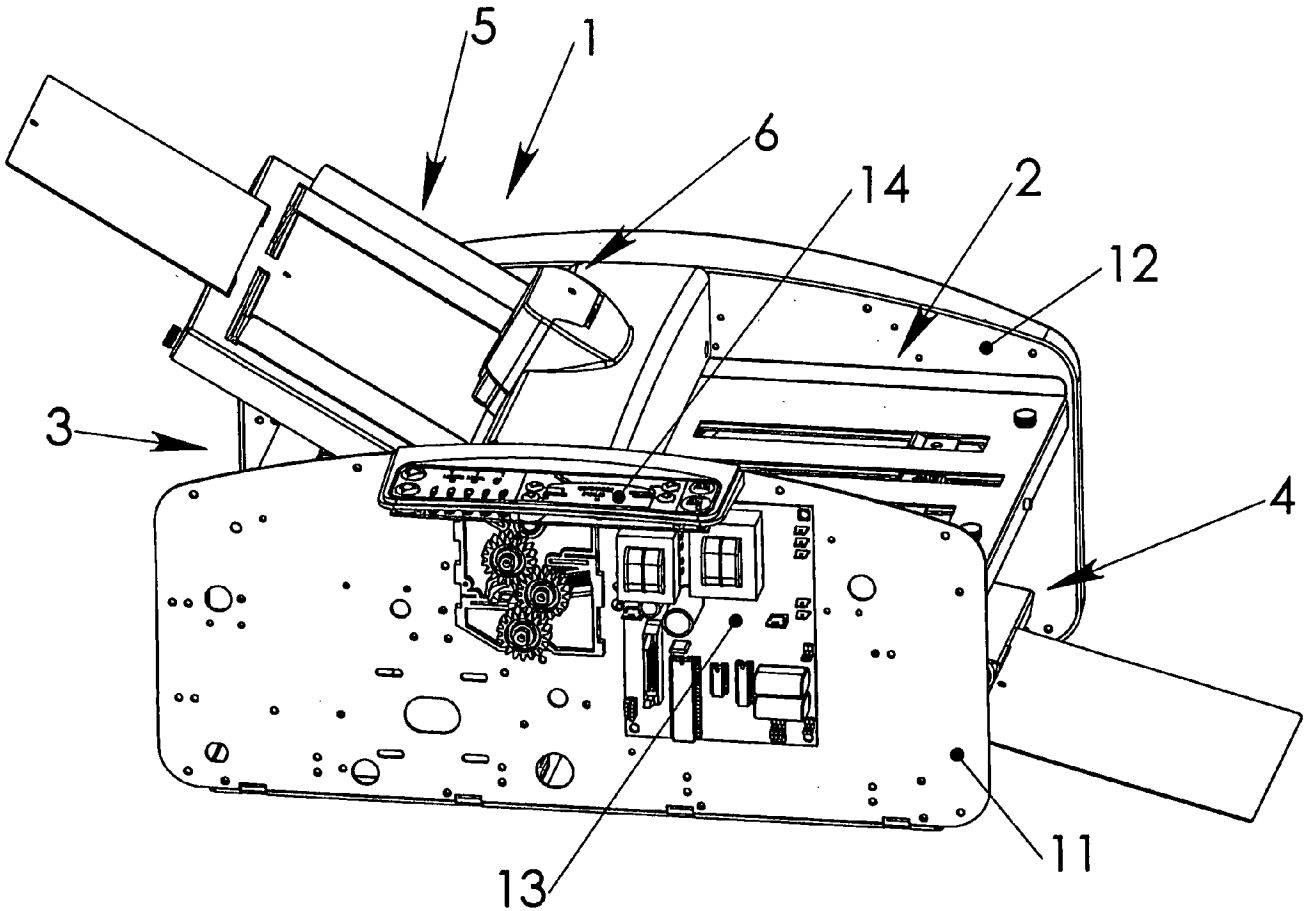
FIG. 1 is a perspective view of the versatile paper folder of the present invention.

FIG. 1 is a perspective view of the automatic paper folder of the present invention. A paper feed assembly 1, a first fold table assembly 2, a second fold table assembly 3, and an exit conveyor table assembly 4 are substantially sandwiched between a front frame panel 11 and a back frame panel 12. The paper feed assembly 1 comprises a paper feed table assembly 5 and a paper feed control assembly 6.

A microprocessor 13 and a means for the user input 14 are disposed on the outside of the front frame panel 11. A front cover is not shown in order to show the microprocessor 13.

Figure 2:
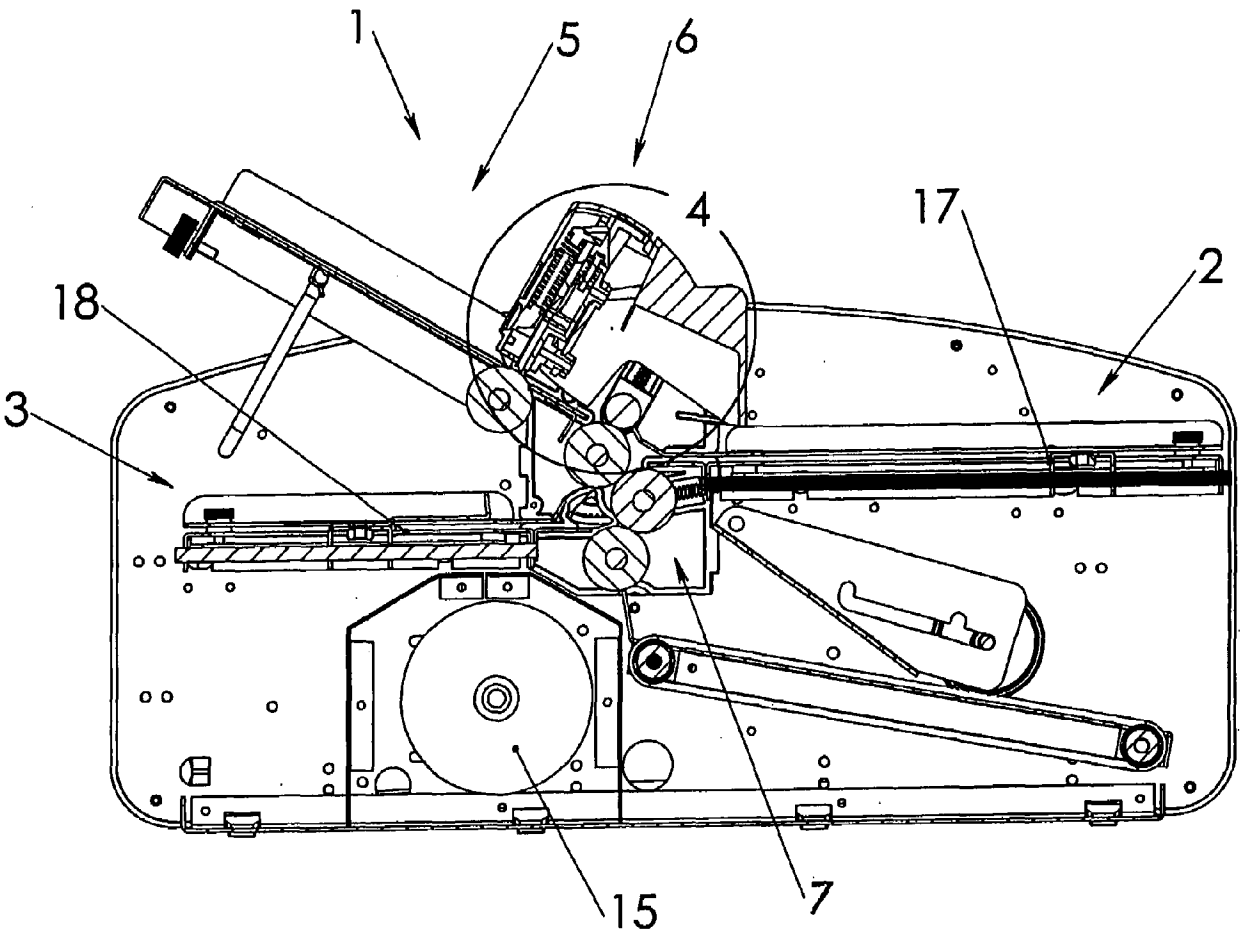
FIG. 2 shows a cross-section view of the versatile folder taken along lines 2—2 of FIG. 1.

FIG. 2 shows a cross-section view of the versatile folder taken along lines 2—2 of FIG. 1.

The paper feed control assembly 6 is adjustably disposed on the paper feed table assembly 5. A roller assembly 7, substantially sandwiched between the front frame panel 11, and the back frame panel 12, is positioned under the paper feed control assembly 6, between the first fold table assembly 2, and the second fold table assembly 3. The roller assembly 7 employs a series of rollers to grab and move the paper being folded through the fold process, and creases the paper as it passes between sets of contacting rollers, and then expels the paper. A main motor 15 drives the rollers of the roller assembly 7.

Figure 3:
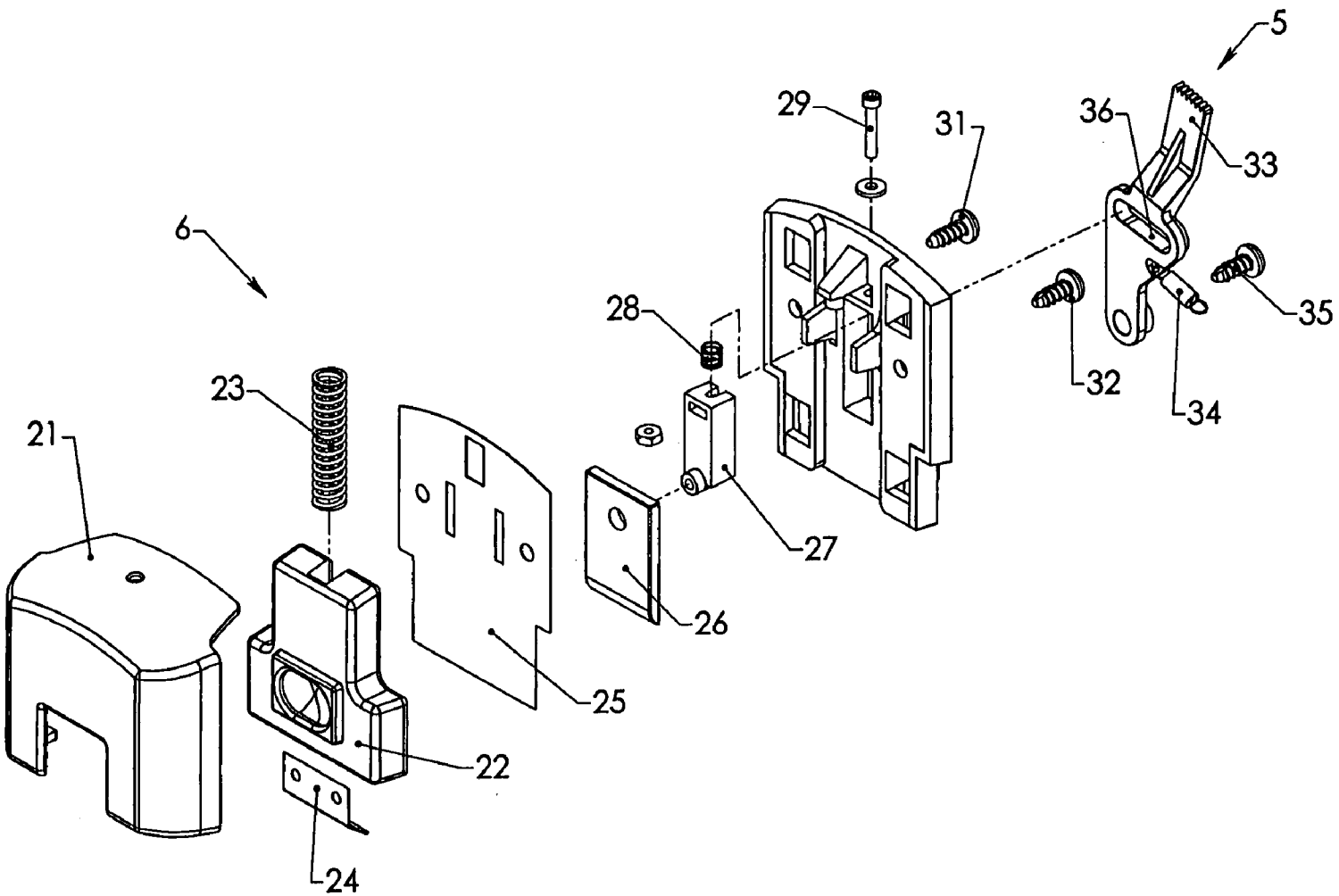
FIG. 3 shows the exploded view of a paper feed control assembly.

FIG. 3 shows the exploded view of the paper feed control assembly 6 comprised of: a front housing 21, a pressure bar 22, a pressure bar spring 23, a leaf spring 24, a spacer 25, a retarder 26, a carrier 27, a carrier spring 28, an adjustment screw 29, a base 30, and simple fasteners 31 & 32. Some components of the paper feed table assembly 5 are also shown on this view: a lever 33, an extension spring 34, and a simple fastener 35. In the mid-section of the lever 33, there is a slot-shaped opening 36.

Figure 4:
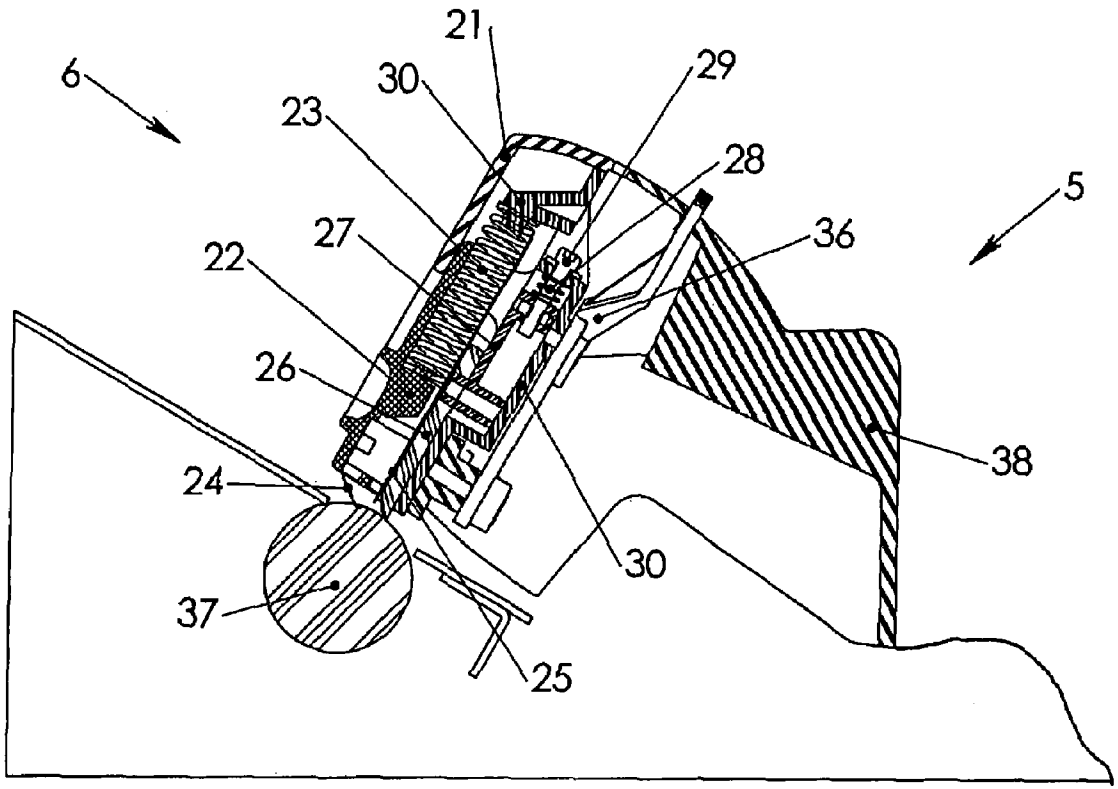
FIG. 4 is an enlarged detail 4 of the FIG. 2 showing the cross-section view of the paper feed control assembly and partial cross-section view of a paper feed table assembly.

FIG. 4 is an enlarged detail 4 of the FIG. 2 showing the cross-section view of the paper feed control assembly 6 as well as a few components of the paper feed table assembly 5.

The pressure bar 22, slidably disposed on the inside of the front housing 21, is urged downward by the pressure bar spring 23. In the process of the preparation for the automatic operation with the paper folder, the user slides the pressure bar 22 upward while placing a stack of paper (not shown) under the bar. The release of the pressure bar 22 results in the compression of the stack of paper under the bar.

A feed wheel 37 is pivotably disposed on a paper feed table assembly 5. The leaf spring 24 is disposed on the bottom portion of the pressure bar 22 directly above, and contiguous to, the feed wheel 37. The leaf spring 24 directs a sheet of paper (not shown) into a proper position between the retarder 26, and the feed wheel 37. The feed wheel 37 feeds a sheet of paper (not shown) into the roller assembly.

The retarder 26 is disposed on the base 30 directly above the feed wheel. The spacer 25 is sandwiched between the pressure bar 22 and the front housing 21 on one side, and the retarder 26 and the base 30 on another. The spacer provides a low-friction barrier between the pressure bar 22 and the pressure bar spring 23 on one side, and the retarder 26.

The carrier 27, adjustably disposed on the base 30, is urged downward by the carrier spring 28. The adjustment screw 29 is disposed on said base 30. When turned, the adjustment screw 29 urges the carrier 27 upward. In-turn, the carrier 27 urges the retarder 26 into a position for the automatic operation.

The position of the retarder 26 for the automatic operation always provides a predetermined distance between the feed wheel 37 and the retarder, the distance which is always smaller than the thickness of the paper being processed. This provides for the automatic processing of nearly any kind of paper available in the market in such a manner that only one sheet of paper at the time is fed into the paper folder.

The paper feed control assembly 6 is held together by the simple fasteners 31 and 32. The paper feed control assembly 6 is disposed on a back housing 38 which is the part of the paper feed table assembly 5.

The lever 33 is pivotably disposed on the back housing 38. The lever 33 is held to the back housing 38 by the simple fastener 35.

The base 30 projects a boss 39 facing the back housing 38. The boss 39 slidably engages the slot-shaped opening 36 of the lever 33. When a bypass is required in order to feed the stapled sets through the automatic paper feed assembly sequentially, the paper feed control assembly 6 can be urged to slide upward by the user turning the lever 33 counterclockwise. The slot-shaped opening 36 of the lever 33, engaging a boss 39 on the base 30, performs as a cam urging the base together with the rest of the paper feed control assembly 6 to slide upward thus providing a space for the stapled set (not shown) between the retarder 26 and the feed wheel 37.

The return of the paper feed control assembly 6 into the original position is provided by the extension spring 35 (shown on FIG. 3) urging the lever 33 to move clockwise. The slot-shaped opening 36, engaging a boss 39, performs as a cam urging the base together with the rest of the paper feed control assembly 6 to slide down into the position for the automatic feeding.

The invention claimed is:

1. An automatic paper folder is claimed comprising:

a paper feed assembly, a first fold table assembly, a second fold table assembly, a exit conveyor table assembly, and a roller drive assembly, a feed wheel, the feed wheel pivotably disposed on said paper feed table assembly, a back housing, and a lever, the lever pivotably disposed on said back housing, said lever having a slot-shaped opening, a front housing, a pressure bar, the pressure bar slidably disposed on the inside of said front housing, a pressure bar spring, the pressure bar spring disposed directly above said pressure bar and urging said pressure bar downward, a leaf spring, the leaf spring affixed the bottom portion of said pressure bar above, and contiguously to, said feed wheel, a base, the base disposed on said back housing, an adjustment screw, the adjustment screw helically disposed on said base, a carrier spring, the carrier spring disposed on said base, a carrier, the carrier disposed on said base, urged downward by said carrier spring, and vertically adjustable with said adjustment screw, a retarder, the retarder adjustably disposed on the base at a predetermined distance to said feed wheel, and a spacer, the spacer sandwiched between said pressure bar and said front housing on one side, and said retarder and said base on another side.

2. The automatic paper folder of claim 1 wherein said base is projecting a boss.

3. The automatic paper folder of claim 1 wherein said slot-shaped opening of said lever of said paper feed table assembly slidably engages said boss of said base of said paper feed control assembly, whereby by moving said lever counterclockwise the user urges said paper feed control assembly to slide upward against said paper feed table assembly.

* * * * *